US005927712A

United States Patent [19]

Curley et al.

[11] Patent Number: 5,927,712

[45] Date of Patent: Jul. 27, 1999

[54] SAMPLE SIGNATURE DELIVERY HAVING ALTERNATE TRANSPORT PATH AWAY FROM DECELERATION DEVICE

[75] Inventors: Richard D. Curley, Dover; Kevin Lauren Cote, Durham, both of N.H.

[73] Assignees: Heidelberg Harris, Dover, N.H.; Heidelberger Druckmaschinen AG, Heidelberg, Germany

[21] Appl. No.: 08/747,962

[22] Filed: Nov. 12, 1996

[51] Int. Cl.[6] ..... B65H 5/02

[52] U.S. Cl. ..... 271/277; 271/82; 271/184; 271/300; 271/302

[58] Field of Search ..... 271/82, 182, 184, 271/185, 187, 225, 270, 277, 300, 302, 303

[56] References Cited

U.S. PATENT DOCUMENTS

| | | | |
|---|---|---|---|
| 1,919,169 | 7/1933 | Plausics . | |
| 3,894,479 | 7/1975 | Anikanov et al. | 271/303 X |
| 3,999,454 | 12/1976 | Tiso et al. | 271/82 X |
| 4,290,595 | 9/1981 | Thünker | 271/277 |
| 4,582,316 | 4/1986 | Wirz | 271/300 X |
| 4,629,175 | 12/1986 | Fischer et al. | 271/202 |
| 4,761,003 | 8/1988 | Barrois et al. | 271/277 X |
| 5,141,221 | 8/1992 | Mack et al. | 271/270 |
| 5,249,943 | 10/1993 | Breton | 83/154 |
| 5,390,911 | 2/1995 | Schmid | 271/300 |
| 5,427,005 | 6/1995 | Breton | 83/154 |
| 5,452,886 | 9/1995 | Cote et al. | 271/270 |
| 5,702,100 | 12/1997 | Novick et al. | 271/302 |

FOREIGN PATENT DOCUMENTS

| | | |
|---|---|---|
| 0 638 503 | 2/1995 | European Pat. Off. . |
| 1 436 517 | 11/1968 | Germany . |
| 2 259 288 | 3/1993 | United Kingdom . |

*Primary Examiner*—Boris Milef
*Attorney, Agent, or Firm*—Kenyon & Kenyon

[57] ABSTRACT

A device for selectively extracting samples from a folding unit is provided. The device includes a signature transport system for transporting signatures to a deceleration device. The deceleration device has a plurality of rotating arms with gripping elements assigned thereto for seizing signatures emerging-from the transport system. Portions of the signature transport system or selectively actuable gripping elements either deliver sample signatures to a delivery system or deviate sample signatures into an alternate transport path.

22 Claims, 4 Drawing Sheets

SAMPLE SIGNATURE DELIVERY HAVING ALTERNATE TRANSPORT PATH AWAY FROM DECELERATION DEVICE

FIELD OF THE INVENTION

The present invention relates to a sample signature delivery, particularly to a sample signature delivery in a folding apparatus of a rotary printing press.

BACKGROUND OF THE INVENTION

U.S. Pat. No. 4,290,595 describes a rotatable advance gripper drum assembly for sheet-fed rotary printing presses. This assembly has an advance gripper drum and a gripper bridge movable relative to the drum, including a crank-driven linkage transmission device which is disposed on and rotatable with the drum and operatively connected to the gripper bridge for moving the gripper bridge.

U.S. Pat. No. 4,629,175 purports to show a method and apparatus for the stream-fed delivery of sheet-like products. Sheet-like products coming out of a folding apparatus are first transported some distance before being caused to overlap. To provide a regular feed stream arranged without damage to the products, the products are engaged on a support by grippers that are moved along a preferably arcuate path, in the course of which the products are slowed down by the grippers to the speed of a delivery belt, whereon the products are then deposited. This solution does not refer to deviation of sample signatures or the like.

U.S. Pat. No. 5,141,221 describes a deceleration device in a folder of a rotary printing press. A deceleration device for folded products conveys folded products one behind the other while being gripped by decelerable transport devices. The oppositely arranged decelerable transport devices are driven by a planetary gearing. While planetary gears rotate around a sun gear, an instantaneous center describes a cardioid which, via drive brackets, causes the transport devices to take different speeds during rotation of the planetary gears. This disclosure does not describe or suggest a deviation of sample signatures or sample folded products.

U.S. Pat. Nos. 5,249,493 and 5,427,005 describe devices for extracting samples from a folder. These devices include a pair of cutting cylinders including a blade cylinder and a grooved cylinder, the blade cylinder having at least one cutting blade mounted on the periphery thereof, the grooved cylinder having at least one groove bar, a respective holding device for signatures assigned to the groove bar, conveyor tapes for conveying signatures emerging from the nip between the blade cylinder and the grooved cylinder of the cutting cylinder pair to a signature delivery and to a conveyor unit assigned to the cutting cylinder-pair and a device for remotely controlling the holding devices. The devices for extracting samples disclosed in these two patents are assigned to the pair of cutting cylinders for immediately seizing a folded product. The devices are actuated mechanically, pneumatically or through solenoids.

In order to inspect a sample signature coming from a printing press, press operators generally grab the signatures from the shingled stream at the folder delivery. This can cause a disruption of the shingled stream and, in turn, cause problems in the downstream equipment.

SUMMARY OF THE INVENTION

In accordance with the present invention, a device for selectively extracting samples from a folding unit is provided which includes a signature transport system for conveying signatures to a deceleration device. The deceleration device has a plurality of rotating arms with gripping elements assigned thereto for seizing signatures emerging from the signature transport system. The signature transport system is operable to guide signatures into either a primary transport path or into an alternate transport path. The primary transport path leads to a downstream delivery system, while the alternate transport path, includes, at its lower end, a collecting area for receiving sample signatures. The signatures can be diverted towards the alternate transport path by selective actuation of the gripper elements, or by pivoting a lower portion of the signature transport system. In this manner, sample signatures can be extracted from the folder delivery system without disrupting the signature delivery stream.

In accordance with a first embodiment of the present invention, the rotating arms of the deceleration device have gripping elements mounted thereon. The gripping elements may include a stationary member and a movable member. Actuating members, such as rods, levers or the like, are operative to open the gripping elements to release signatures when they reach the primary conveying path, and to close the gripping elements to seize signatures as they exit an output of the signature transport system. The movable member of the gripping element could, for example, be a gripper finger or the like. An alternate transport path having an arc-shaped curvature is arranged below the deceleration device. The upper edge of the curvature is arranged so as to be offset with respect to a signature conveying path. Particularly, the upper edge of the curvature is offset with respect to the circumferential path of the gripper elements of the deceleration device. If the signatures are to be conveyed along the primary transport path, the gripping elements will seize the signatures as they emerge from the signature transport system and release them into the primary conveying path. To accomplish this, the gripper elements are opened prior to the exit nip of the signature transport system, and are closed as the signatures are received in the opened gripper elements. If the signatures are to be conveyed along the alternate transport path, the gripping elements will remain closed as the signatures exit the signature transport system, thereby deflecting the signatures into the alternate transport path, and into the collecting area.

In accordance with a second embodiment of the present invention, a lower portion of the signature transport system is pivotable about a pivot axis. The lower portion of the transport system includes a lower conveying device, such as a conveying tape. A pivotable guiding element may be provided which pivots together with the lower conveying device. In order to deviate sample signatures, the lower conveying device, as well as the guide element are pivoted towards the alternate path and into the collecting area. In this manner, sample signatures are delivered to the collecting area while maintaining control over the signatures during delivery.

DETAILED DESCRIPTION OF THE INVENTION

Figure 1:
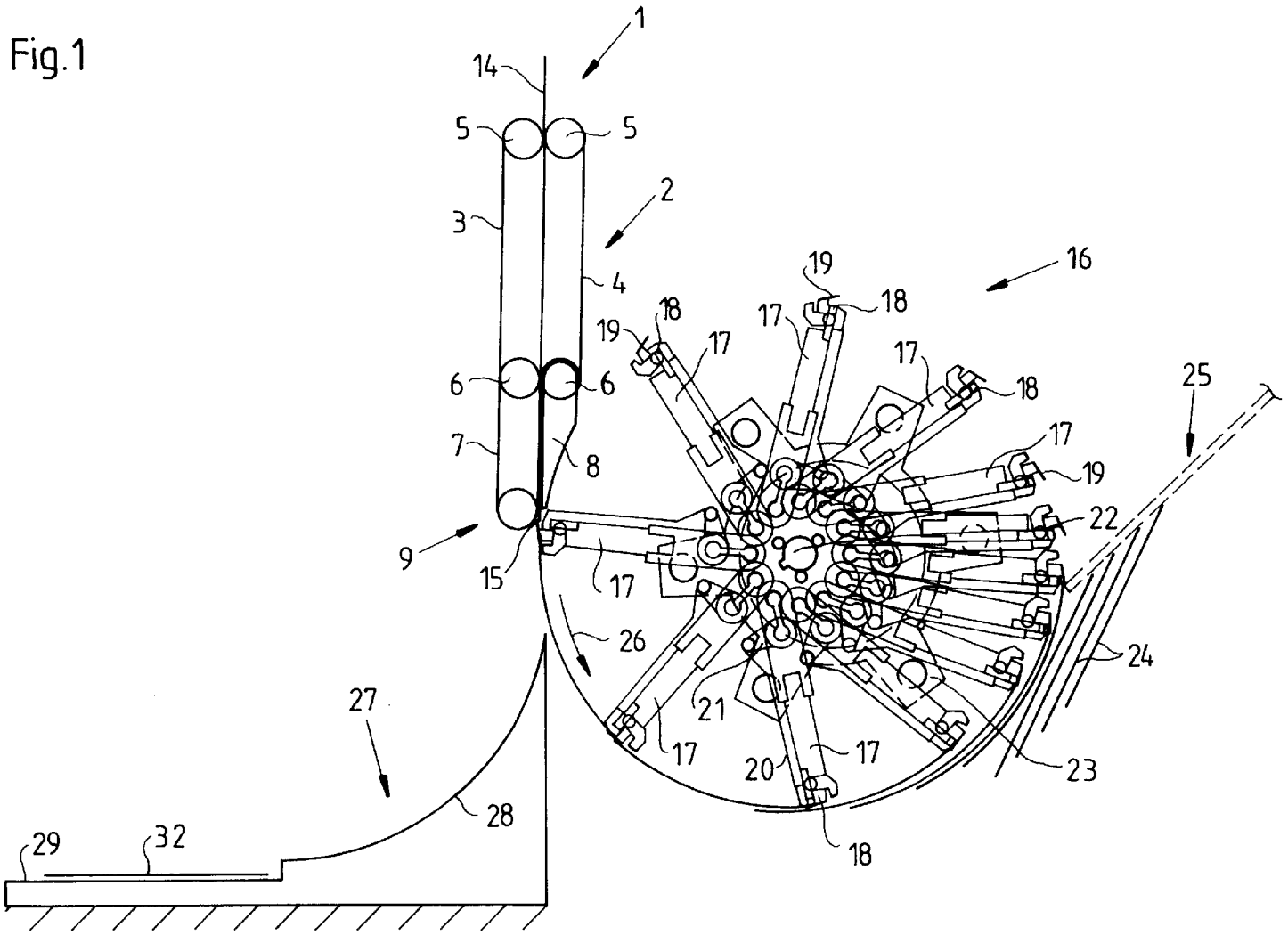
FIG. 1 shows a transport system delivering signatures to a deceleration device.
Figure 2:
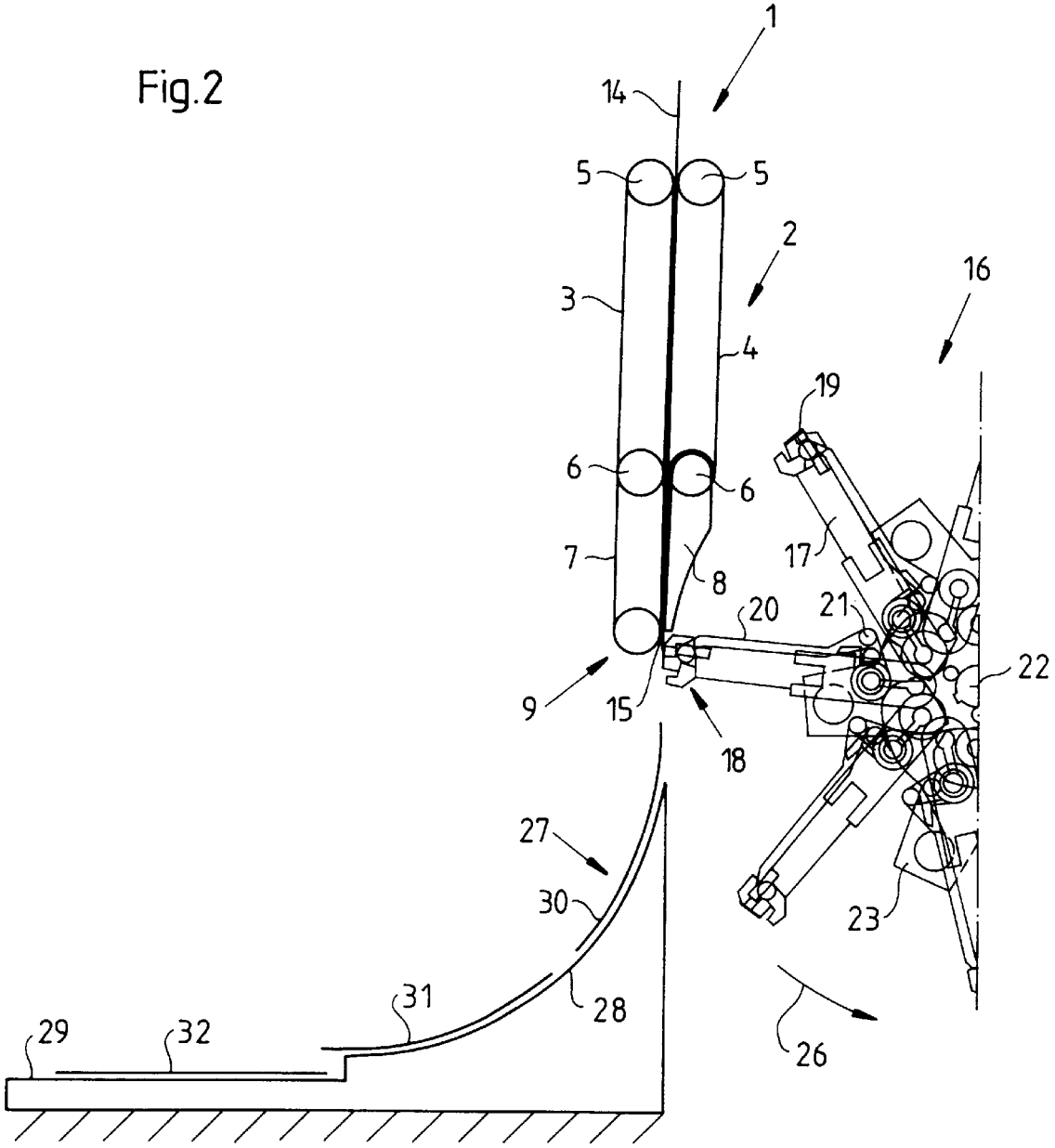
FIG. 2 shows a gripping element of the deceleration device deviating a sample signature to an alternate transport path in accordance with a first embodiment of the present invention.
Figure 3:
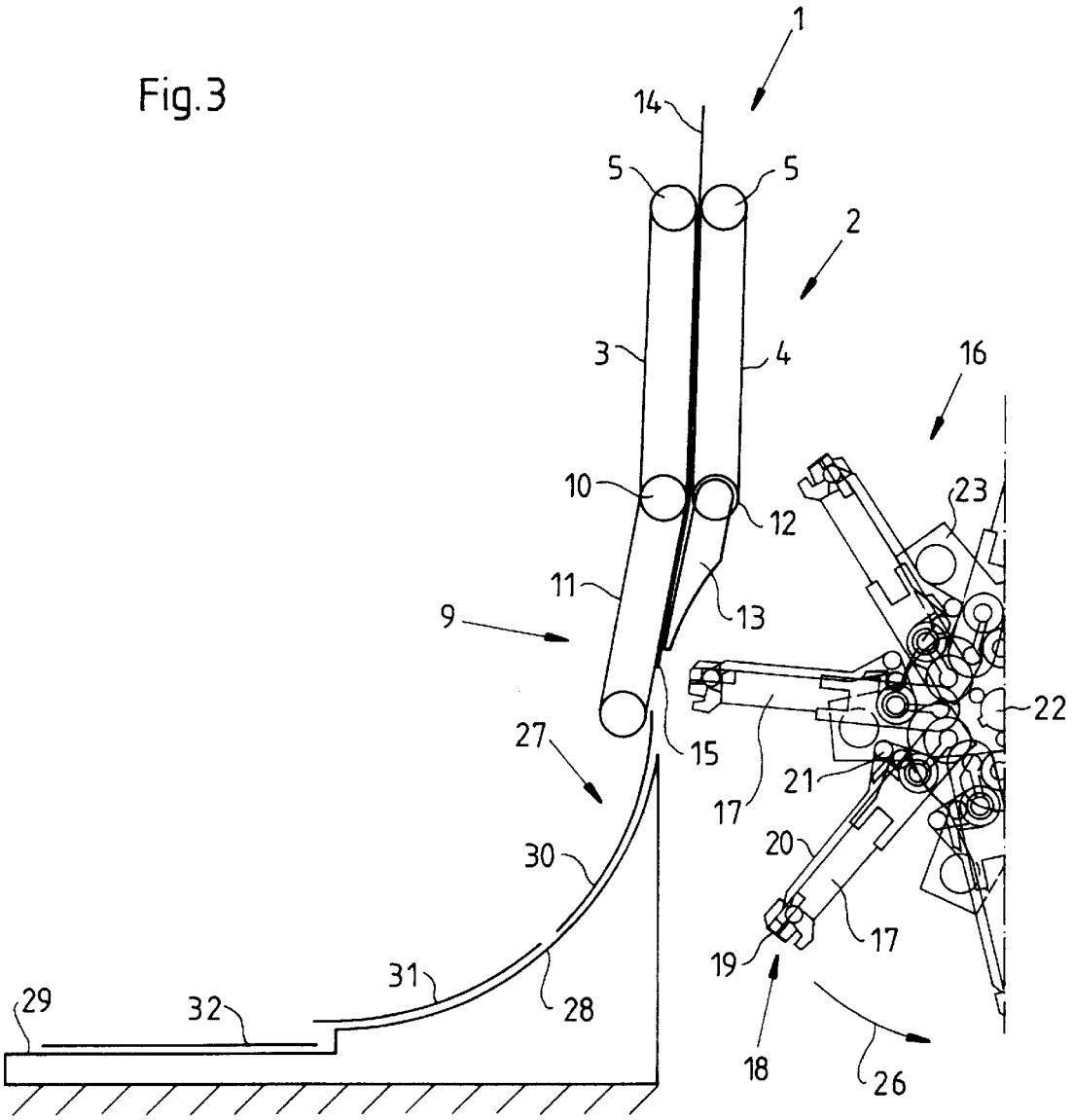
FIG. 3 shows a second embodiment of the present invention including a pivotable lower portion of the transport system deviating sample signatures to an alternate transport path.

FIG. 1 is a side view of a system for transporting signatures to a rotating deceleration device 16. A transport system 2, having a first tape 3 and a second tape 4, forms a signature conveying path 1. The first and second tapes 3, 4 move around upper and lower tape rollers 5, 6, respectively. Below the first tape 3 is arranged a lower first tape 7 which either can be fixed in its vertical position as shown in FIGS. 1 and 2, or which can be pivotably mounted as illustrated in FIG. 3. Opposite the lower first tape 7 there is arranged a guiding element 8. The guiding element 8, like the lower first tape 7, can either be fixed in its position or pivotably mounted. A primary transport path, including a delivery system 25, is shown to the right of the deceleration device 16. An alternate transport path 27, including a collecting area 29, is shown to the left of the deceleration device 16. As one of skill in the art will appreciate, the first and second tapes 3,4 may each be comprised of a single tape, or of a set of narrow tapes, arranged across the length of the rollers 5, 6.

Signatures 14 emerging with their leading edges 15 from the transport system 2 are seized by gripping elements 18 of the deceleration device 16. An illustrative embodiment of a suitable deceleration device 16 is described in detail in U.S. Pat. No. 5,452,886 entitled Device for Slowing down Signatures in a Folding Machine, which is hereby incorporated by reference. Referring to FIG. 1, the deceleration device 16 has a plurality of pivot arms 17 mounted on a disk 33 rotating about an axis of rotation 22. A respective gripping element 18 is arranged on an outer end of each pivot arm 17.

Figure 1A:
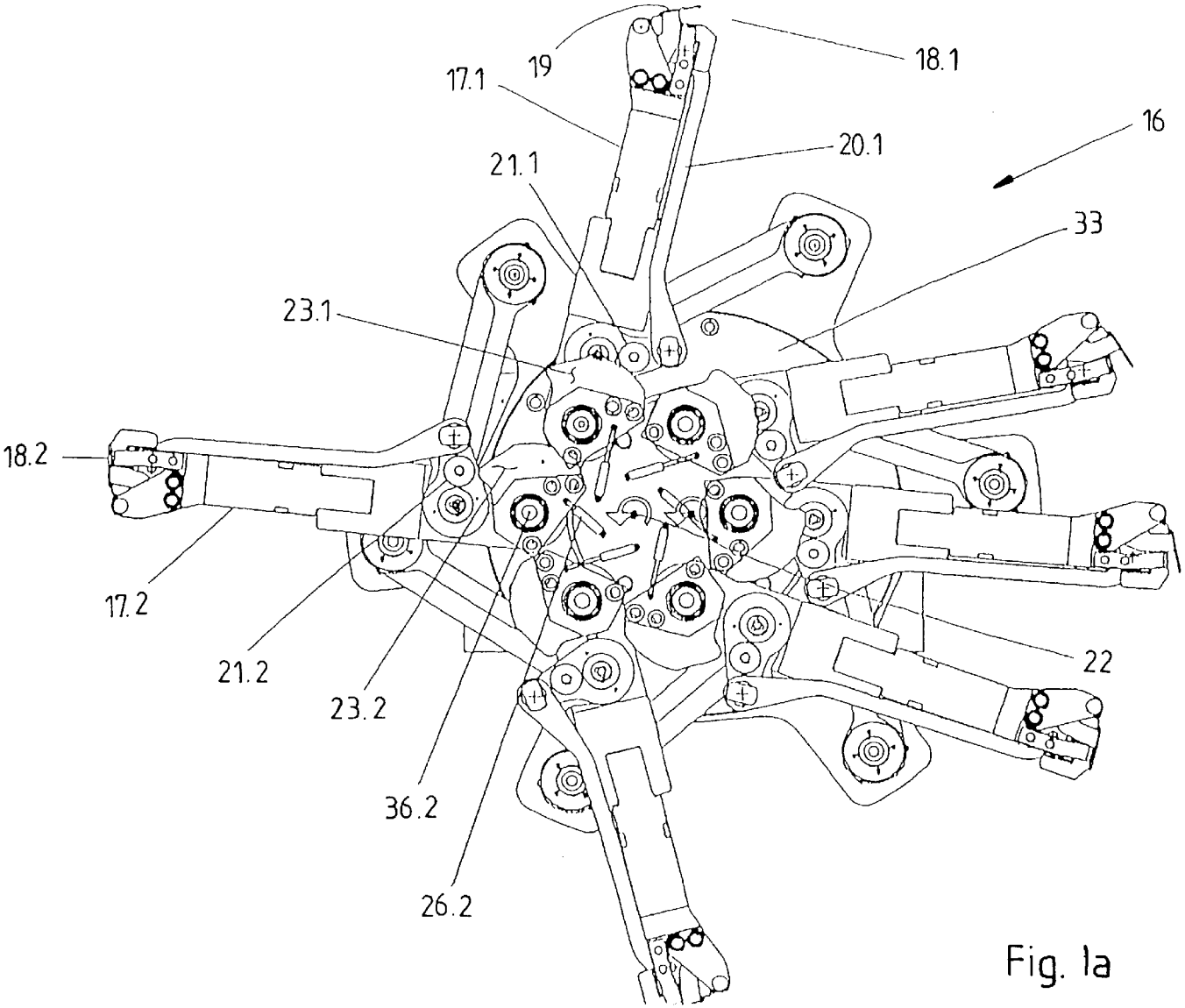
FIG. 1A shows the deceleration device in greater detail.

As shown more fully in FIG. 1A, a respective linkage lever 20 is connected to each pivot arm 17 as well. A plurality of gripper cams 23 are mounted on a pivot disk (not shown) that rotates about the axis 22. Each gripper cam 23, includes an actuator 26. In addition as shown in FIG. 1A, for each gripper cam 23, a respective cam follower 21 is mounted to the spring link 100 and each spring link 100 is mounted to a respective arm 17 and a corresponding lever 20.

Upon common rotation of the control cams 23 and the pivot arms 17 about the axis 22, a non-uniform velocity profile is imposed on the pivot arms 17 during a complete revolution about the axis of rotation 22. Referring once again to FIG. 1, the pivot arms 17 reach their maximum tangential velocity below the transport system 2, from the lower end of which the leading edges 15 of the signatures 14 emerge. The minimum tangential velocity of the pivot arms 17 is reached in the region opposite a delivery system 25 to which the slowed-down signatures 24 are conveyed.

Each gripper finger 19 can be selected to deliver a signature either to the primary transport path and delivery system 25 or to the alternate transport path 27.

When selected to deliver a signature to the primary transport path, gripper fingers 19 are closed below the transport system 2, in order to seize a signature's leading edge 15. The signatures are then slowed down along an arcuate path (arrow 35) by the deceleration of the pivot arms 17. Upon delivery of the slowed down signatures 24 to the delivery system 25, the gripper fingers 19 are opened. After delivering the slowed down signatures 24 to the delivery system 25, the gripper fingers 19 remain open until they pass below an output 34 of the signature transport system 2 and then close to seize new signatures 14.

However, if, after delivering a signature to the delivery system 25, a gripper finger 19 is selected to deviate an emerging signature 14 to the alternate transport path 27, the gripper finger will be closed prior to reaching the output 34 of the signature transport system 2. As shown in FIG. 2, the pivot arm 17 follows its normal path of rotation, but if the gripper element 18 is closed then the gripper element 18 does not seize the signature 14. As a leading edge 15 of a signature emerges from the output 34 of the lower portion 9 of the transport system 2, the leading edge 15 will be pushed by the closed gripper element 18 over the upper edge of the alternate transport path 27, and the signature (30, 31, 32) will be diverted to the alternate transport path 27. In this manner, the closed gripper element 18 serves to deviate a signature designated as being a sample to the alternate transport path 27, and into a collecting area 29. Once the signatures 30, 31, 32 are received in the collecting area 29, the press operator can inspect the signatures 14 for defects without disrupting delivery of signatures 14 to the delivery system 25.

The number of samples to be deviated into the alternate transport path 27 depends upon the number of gripper elements 18 selected to be kept closed. Referring once again to FIG. 2, for example, three adjacent signatures 30, 31 and 32 have been chosen to become sample signatures to be collected in the collecting area 29. After delivering the slowed down signatures 24 to the delivery system 25, the gripper elements 18 selected to deviate a signature's leading edge 15 can be closed. Thus, during rotation of the pivot arms 17 about its axis of rotation 22 from the delivery system 25 to the signature transport system 2, the selected gripper elements 18 remain closed to deviate sample signatures to the alternate conveying path 27.

The opening and closing of the movable members 19 of the gripping elements 18, i.e., the gripper fingers, can be controlled remotely by an operator or by a computer system (not shown). This opening and closing may be effected by controlling the actuators 26 to open or close the gripping elements 18.

Referring to FIG. 1A, gripper elements 18, are held in a closed position by a spring (not shown) and are opened if the gripper cam 23 engages the cam follower 21, moving linkage lever 20 outward to open the gripper 18. For example, pivot arm 17.1 is shown with gripper element 18.1 opened. Gripper cam 23.1 is in contact with cam follower 21.1, forcing the gripper element 18.1 to be opened through linkage lever 20.1. In contrast, pivot arm 17.2 is shown with gripper element 18.2 closed. Gripper cam 23.2 has been rotated about its center 36.2 by actuator 26.2, thereby disengaging the gripper cam 23.2 from cam follower 21.2. Thus, since the cam follower 21.2 is not in contact with the gripper cam 23.2, the gripper element 18.2 remains in the closed position.

While the first embodiment of the present invention is described above with reference to gripper fingers 19, it should be clear that other types of gripper elements, such as the rotating gripper elements described in the '886 patent, can also be used.

FIG. 3 shows a second embodiment of the present invention. In this embodiment a lower portion 9 of the signature transport system 2 is pivotably mounted on pivot axes 10 and 12. The signatures 14 conveyed by the signature transport system 2 are deviated by the pivotable flat tape 11 and by a pivotably mounted guiding element 13 integrated into the lower portion 9 of the transport system 2. Thus, selective actuation of individual gripping elements 18 upon rotation of the pivot arms 17 is not necessary.

When signatures are to be delivered to the primary transport path, the lower portion 9 of the transport system 2 is arranged substantially vertical with respect to the left-hand tape 3 and the right-hand tape 4 of the transport system 2 so that the signatures will be released to the gripper elements 18. By contrast, in order to deliver the signatures to the collecting area 29, the lower portion 9 of the transport system 2 is pivoted as shown in FIG. 3 so that the emerging signatures 14 are led to an arc-shaped curvature 28 of the alternate transport path 27. In this way, a number of consecutive sample signatures can be deviated into the alternate transport path 27 with a minimum of interference in the normal course of production and delivery.

In accordance with a preferred embodiment of the present invention (as shown in FIG. 1) the delivery system 25 is a single or dual track system having a plurality of gripper-conveyers for individually seizing a slowed-down signature 24 for distribution to further post-press equipment. Illustrative embodiments of such gripper-conveyers are described in application Ser. No. 08/504,868 entitled "APPARATUS FOR SPLITTING A PRODUCT STREAM, and application Ser. No. 08/504,867 entitled "APPARATUS FOR DELIVERY OF SHEET-LIKE PRODUCTS", the specifications of which are hereby incorporated by reference.

What is claimed is:

1. A device for selectively extracting samples from a folding unit, comprising:

a deceleration device having a plurality of rotating arms, each rotating arm having an actuatable gripping element attached thereto;

a signature transport system for transporting signatures towards the deceleration device, the signature transport system having an output, the gripping elements seizing signatures emerging from the output of the signature transport system at the output of the signature transport system; and an alternate transport path having an upper edge arranged below the output of the signature transport system, the signature transport system delivering signatures to the alternate transport path when not gripped by one of the gripping elements, the signature transport system delivering signatures to the deceleration device when the signatures are gripped by one of the gripping elements.

2. The device according to claim 1, further comprising an actuating member coupled to each gripping element for opening and closing the gripping elements.

3. The device according to claim 1, further comprising an actuating member coupled to each gripping element, each gripping element further including a stationary member and a movable member, each actuating member operable to move a respective movable member towards a respective stationary member to close a respective gripping element, each actuating member moving the respective movable member away from the respective stationary member to open the respective gripping element.

4. The device according to claim 3, wherein the movable member is a gripper finger.

5. The device according to claim 1, wherein the alternate transport path has an arc-shaped curvature.

6. The device according to claim 5, wherein an upper edge of the arc-shaped curvature is offset with respect to a circumferential path of the gripping elements.

7. The device according to claim 1, further comprising a lower conveying device pivotably mounted on a pivot axis, and wherein the lower portion of the signature transport system is pivotable about the pivot axis.

8. The device according to claim 7, wherein the lower conveying device includes a guiding element.

9. The device according to claim 8, wherein the lower conveying device further includes a transport tape, and wherein the pivot axis includes a first pivot axis and a second pivot axis, the guiding element mounted on the first pivot axis, the transport tape mounted on the second pivot axis.

10. The device according to claim 5, wherein the alternate transport path includes a sample collecting area.

11. The device according to claim 1, further comprising a delivery system arranged adjacent the deceleration device, the delivery system conveying the signatures received from the deceleration device.

12. The device according to claim 11, wherein the delivery system comprises a gripper-conveyer track for conveying signatures received from the deceleration device.

13. A device for selectively extracting samples from a folding unit, comprising:

a deceleration device having a plurality of rotating arms, each rotating arm having a selectively actuatable gripping element attached thereto, the deceleration device feeding signatures to one of a primary transport path and an alternate transport path;

a signature transport system for transporting signatures towards the deceleration device, the gripping elements following a circumferential path which passes an output of the signature transport system; and an alternate transport path arranged below the output of the signature transport system, the gripping elements gripping the signatures for conveyance to the primary transport path by moving the gripping elements between an open position and a closed position as they pass the output of the signature transport system, the gripping elements diverting the signatures for conveyance to the alternate transport path by remaining in the closed position as they pass the output of the signature transport system.

14. The device according to claim 13, further comprising an actuating member coupled to each gripping element for opening and closing the gripping element.

15. The device according to claim 13, further comprising an actuating member coupled to each gripping element, each gripping element further including a stationary member and a movable member, each actuating member operable to move a respective movable member towards a respective stationary member to close a respective gripping element, each actuating member moving the respective movable member away from the respective stationary member to open the respective gripping element.

16. The device according to claim 15, wherein the movable member is a gripper finger.

17. The device according to claim 13, wherein the alternate transport path has an arc-shaped curvature.

18. The device according to claim 17, wherein an upper edge of the arc-shaped curvature is offset relative to a vertically extending conveying path of the signature transport system

19. The device according to claim 17, wherein an upper edge of the arc-shaped curvature is offset with respect to a circumferential path of the gripping elements.

20. The device according to claim 13, wherein the alternate path includes a sample collecting area.

21. The device according to claim 13, further comprising a delivery system arranged in the primary transport path, the delivery system conveying the signatures received from the deceleration device.

22. The device according to claim 21, wherein the delivery system comprises a gripper-conveyer track for conveying signatures received from the deceleration device.

* * * * *